US008746689B1

(12) United States Patent
Herrmann et al.

(10) Patent No.: US 8,746,689 B1
(45) Date of Patent: Jun. 10, 2014

(54) SYSTEMS, APPARATUS, AND METHODS FOR AUTOMATIC STACKING SUPPORT CONFIGURATION AND UNLOAD CONFIGURATION USEFUL FOR SUBSTRATE STACKER SUPPORT IN PRINTING SYSTEMS

(71) Applicant: Xerox Corporation, Norwalk, CT (US)

(72) Inventors: Douglas K. Herrmann, Webster, NY (US); Derek A. Bryl, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/754,955

(22) Filed: Jan. 31, 2013

(51) Int. Cl.
*B65H 31/00* (2006.01)
*B65H 31/30* (2006.01)

(52) U.S. Cl.
USPC ..... 271/207; 271/213; 414/790.1

(58) Field of Classification Search
USPC ..... 271/207, 162, 213, 214, 215, 218; 108/52.1, 53.5; 414/347, 389, 391, 414/399, 608, 788, 789.9, 79, 790.1, 790.8, 414/795.8, 795.9, 796.1, 796.5
See application file for complete search history.

(56) References Cited

U.S. PATENT DOCUMENTS

| | | | | |
|---|---|---|---|---|
| 4,195,963 | A * | 4/1980 | Levkoff et al. | 414/802 |
| 4,890,825 | A * | 1/1990 | McCormick et al. | 271/188 |
| 5,820,539 | A * | 10/1998 | Strahm | 493/412 |
| 7,885,597 | B2 * | 2/2011 | Gast et al. | 399/389 |
| 7,971,875 | B2 * | 7/2011 | Iino et al. | 271/213 |
| 8,556,253 | B2 * | 10/2013 | Okazaki | 271/164 |
| 2005/0017430 | A1 * | 1/2005 | Takahashi et al. | 271/10.01 |
| 2010/0247199 | A1 * | 9/2010 | Tamura et al. | 399/397 |
| 2012/0288354 | A1 * | 11/2012 | Moore | 414/790.1 |

* cited by examiner

*Primary Examiner* — Kaitlin Joerger
(74) *Attorney, Agent, or Firm* — Ronald E. Prass, Jr.; Prass LLP

(57) ABSTRACT

A stacker support with automatic unload function for flexible media includes a first set of ribs and a second of ribs. The stacker support is moved between a first UP position and a second unloading position. In the first UP position and loading positions, the first set of ribs and the second set of ribs are aligned so that their surfaces from a single uniform continuous surface for supporting stack of substrate sheets. In the second unloading position, the top surface of the second set of ribs is caused to move below the top surface of the first set of ribs whereby the top surface of the first set of ribs forms a ribbed surface that supports stacked sheets. The gaps formed thereby permit unloading by a cart having offset ribs.

11 Claims, 4 Drawing Sheets

SYSTEMS, APPARATUS, AND METHODS FOR AUTOMATIC STACKING SUPPORT CONFIGURATION AND UNLOAD CONFIGURATION USEFUL FOR SUBSTRATE STACKER SUPPORT IN PRINTING SYSTEMS

FIELD OF DISCLOSURE

The disclosure relates to media or substrate sheet processing. In particular, the disclosure relates to substrate stacker trays or supports suitable for stacking printable substrates such as paper and for subsequent unloading of a substrate stack.

BACKGROUND

Printing and media processing systems may be configured to handle large stacks of media or sheets of printable substrate such as paper or other flexible substrate. For example, finishers in printing systems may generate large stacks of printed media. Such media stacks must be formed on a uniform or continuously flat surface that has a larger area than the area of the sheet surface to be stacked. The stack may then be unloaded from the media stacker.

A typical stack may include about 3000 sheets of media. In related art systems that stack of media must be unloaded by hand. For large media stacks, the stack may be unloaded by hand in multiple separate portions. Ribbed stacker trays have been incorporated into some related art media processing systems. Ribbed stacker trays accept an offset ribbed configuration of an unloading cart support, enabling the cart support to slide under and remove an entire media stack at once.

SUMMARY

Improved stacker support apparatus and substrate tracking methods are desired. It has been found that related art ribbed stacker trays may damage substrates in a substrate stack. For example, a bottom or stacker support-contacting surface of the stack may be damaged by the stacker support when a substrate stack become too large; the weight of the stack may press the bottom of the stack onto the ribbed tray, permanently deforming one or more substrate sheets of the stack. Also, because the ribbed stacker tray is designed to have rib-spacing that accommodated receiving offset ribs of a support of an unloading cart, the rib spacing is not designed to accommodate all substrate sheet sizes. The rib spacing may not align with a desired paper length and the trail edge of some portion of the sheet may not fall on the rib portion of the tray. The unsupported trail edge of the sheet may become curled while hanging as a stack is being formed. Apparatus and methods are provided that include a stacker tray having a flat tray formation in a first substrate stacking position. The stacker tray automatically converts to a ribbed configuration in a second stack unloading position.

In an embodiment, systems may include a media stacking system suitable for processing flexible substrate sheets, comprising a stacker support, the stacker support including a first set of a ribs and a second set of ribs; and a housing, the stacker support being configured move within the housing between a first position and a second position, wherein the first position is a substrate loading position and the second position is a substrate unloading position.

Systems may include the first set of ribs and the second set of ribs being separately movable, and being aligned in the first position to form a flat surface for supporting the substrate sheets. Systems may include the first set of ribs and the second set of ribs being unaligned in the second position whereby a top surface of the first set of ribs forms a ribbed surface for supporting the substrate sheets. The first set of ribs may have a greater height than the height of the second set of ribs. The second set of ribs may be connected to an elevator system for causing movement of the stacker support.

Systems may include at least one rib of the first set of ribs defining an aperture; a pin slidably seated within the aperture of the at least one rib of the first rib set, the pin being connected to the second rib set. The pin and the aperture may be configured wherein when the elevator system causes the second set of ribs to move toward the first position, the second set of ribs causes the pin to move to contact a first end of the aperture to lift the first set of ribs during the movement to the first position.

The pin and the aperture may be configured wherein when the elevator system causes the second set of ribs to move toward the first position, the first set of ribs may be stopped while the second set of ribs continues to move, the pin sliding along the aperture to a second end of the aperture until the second set of ribs is stopped at the second position.

In an embodiment, apparatus may include a stacker apparatus, comprising a first set of ribs; and a second set of ribs, the first set of ribs being taller than the second set of ribs, and the first set of ribs being separately movable from second set of ribs. Apparatus may include a floor, a bottom of the first set of ribs being connected to the floor, the second set of ribs being separately movable from the floor. Apparatus may include at least one pin, the at least one pin being connected to the second set of ribs; and at least one aperture, the at least one aperture being defined by at least one of the first set of ribs, the pin extending through the aperture and being slidably seated therein to permit movement of the second set of ribs separate from the first set of ribs.

In apparatus, the pin and aperture may be configured whereby when the second set of ribs is caused to move toward a loading position, the second set of ribs causes the pin to slide within the aperture until contacting an end of the aperture, wherein a top surface of the first set of ribs and a top surface of the second set of ribs are caused to align to form a uniform continuously flat surface. In apparatus, the pin and the aperture may be configured whereby when the second set of ribs is caused to move toward an unloading position, the second set of ribs causes the pin to slide within the aperture from a point at which the pin contacts a first end the aperture until the pin contacts a second end of the aperture, or a bottom of the second set of ribs contacts a floor of the stacker support.

In an embodiment, methods may include a media stacking method using a stacker support, comprising causing the stacker support to form a uniform flat surface for receiving substrate sheets in a loading position, and a ribbed surface for unloading the substrate sheets in an unloading position. Methods may include positioning the stacker support in a first loading position wherein a first set of ribs of the stacker support and a second set of ribs of the stacker support are aligned so that their respective upper surfaces form the uniform flat surface for receiving the substrate sheets.

Methods may include placing the sheets on the uniform flat surface when the stacker support is in the first position. Methods may include causing the stacker support to be lowered from the first position as sheets are stacked on the support until the support reaches a second unloading position. Methods may include causing the first set of ribs to stop movement at the second unloading position while causing the second set of ribs to continue movement. Methods may include causing the second set of ribs to be lowered until a gap is formed between the top surface of the second set of ribs and the top surface of the first set of ribs, and lateral spacing is formed between the ribs of the first set of ribs, wherein the gap and spacing accommodates offset ribs of an unloading device. Methods may include removing the stacker support from a system housing for permitting access during unloading of stacked substrate sheets; and replacing the stacker support in the system housing after the unloading.

Exemplary embodiments are described herein. It is envisioned, however, that any system that incorporates features of apparatus and systems described herein are encompassed by the scope and spirit of the exemplary embodiments.

DETAILED DESCRIPTION

Figure 1:
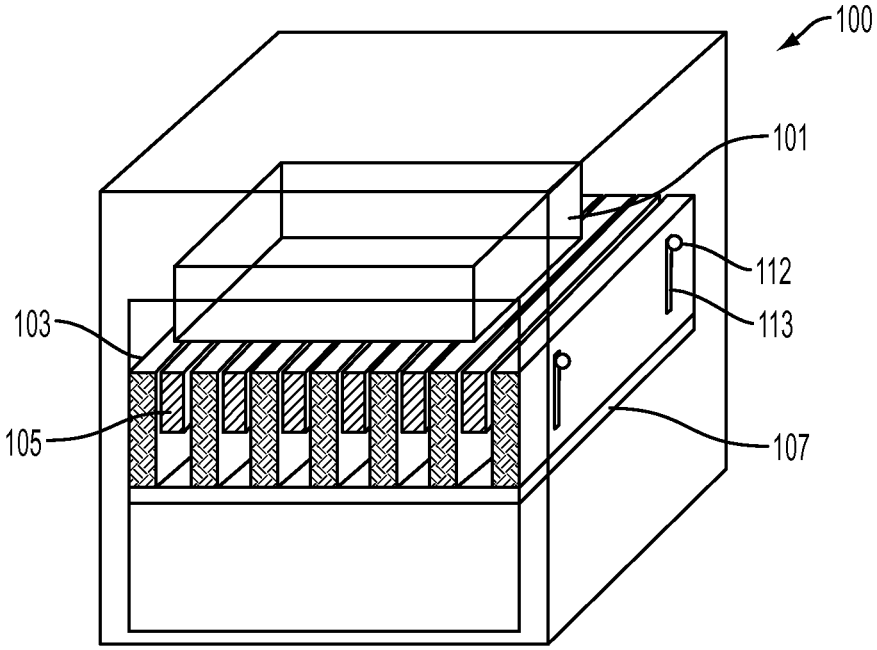
FIG. 1 shows a diagrammatical front perspective view of a substrate processing system in with an exemplary embodiment.

Exemplary embodiments are intended to cover all alternatives, modifications, and equivalents as may be included within the spirit and scope of the systems and methods as described herein.

Media or substrate processing systems, stacking support apparatus, and substrate stacking methods useful for media processing are provided. In particular, a substrate stacking support having a uniformly flat support surface in a stacking position and a ribbed surface in a stack unloading position is provided.

It has been found that related art stacker supports having a uniform or continuously flat support surface do not enable easy unloading of substrate stacks using a cart or similar stack removal and carriage device. As such, large stacks must be unloaded by hand and each stack removed from the related art system in manageable portions.

It has been found that although related art stacker supports having a ribbed configuration provide a means for unloading substrate stacks using a cart, the ribbed configuration can cause deformation of stack or sheets thereof. Stacks that sit on the support for a prolonged period may take be permanently set with an impression of the ribs.

Systems in accordance with an embodiment include a stacker support that is configured to have a uniform, continuous flat support surface when the stacker support is in a substrate stacking position for receiving substrate sheet to form a stack. The stacker support automatically converts to have a ribbed configuration when the stacker support is in a stack unloading position. The ribs are spaced to accommodate offset ribs of a stack unloading cart as is now known or later developed.

The stacker support includes two sets of ribs. When the stacker support is in a substrate stacking position, the first set of ribs and the second set of ribs are arranged to form a uniform or continuous flat surface for receiving one or more substrate sheets. The stacker support is connected to an elevator, which may include components now known or later developed for media stacking systems that can cause the stacker tray to move from a first stacking position to a second unloading position. The elevator enables the stacker tray to descend from a first loading position to accommodate a growing substrate stack before the stacker tray reaches the second unloading position.

The first set of ribs and the second set of ribs may be aligned to form a flat surface to be contacted by a bottom sheet of a substrate stack. The first and second set of ribs may be so aligned at the first position, and at positions between the first and second positions. At the second position, the second set of ribs may be caused to be unaligned with the first set of ribs, thereby causing the first set of ribs to form a ribbed surface when the stacker support is in the second position.

For example, a stacker support in accordance with an embodiment may be configured so that the second set of ribs is locked to the elevator movement of connected elevator components. The first set of ribs may be taller than the second set of ribs. When the stacker tray is moved to the second position, the downward movement of the first set of ribs may be stopped by, for example, a bottom portion of the first set of ribs contacting a structural member of the media processing system. The shorter second set of ribs may continue to descend after the first set of ribs is stopped until the second set of ribs is stopped by, for example, a bottom portion of the second set of ribs contacting the structural member of the media processing system. This causes a top portion of the second set of ribs to descend below a top portion of the first set of ribs when the support is at the second position, forming a ribbed surface upon which a substrate stack may rest for unloading. The stopping of the first set of ribs and continued movement of the second set of ribs when the elevator causes the stacker support to be in the second unloading position forms gaps for accepting offset ribs of a stack unloading cart.

By using elevator motion, no external actuators or motors are necessary to change the support from a flat to a ribbed configuration. This enables a flat tray surface for stacking, and a ribbed tray surface for unloading of substrate sheet stacks. Accordingly, benefits of both the flat and ribbed stacker support surface configuration may be retained as needed for any system that uses a flexible media stacker.

FIG. 1 shows a substrate stacker system in accordance with an exemplary embodiment. In particular, FIG. 1 shows a substrate stacker system 100 containing a media stack. The media stack may include any flexible substrates such as paper sheets.

The system 100 includes a stacker support or tray formed of a first set of ribs 103 and a second set of ribs 105. As shown in FIG. 1, the first set of ribs 103 is taller than the second set of ribs 105. FIG. 1 shows the stacker support in a first position, a stack loading position wherein substrate sheets are placed on the stacker support to form a substrate stack 101. The stacker support is connected to elevator components that can function to cause the stacker support to move between a first a second position, a stack unloading position. Further, the stacker support is configured to descend during stacking to accommodate an increasing stack height until the stacker support reaches the second position. Accordingly, the positions intervening the first or UP stack loading position and the second stack unloading position may be positions at which stack loading occurs.

A system 100 as shown in FIG. 1 includes a stacker support connected to an elevator system (not shown) in which a first set of ribs 103 is stationary with respect to floor 107 of the stacker support. The second set of ribs 105 are movable between an aligned position wherein a top surface of the second set of ribs 105 is aligned with a top surface of the first set of ribs 103, as shown in FIG. 1, and a second position wherein the second set of ribs 105 rests on the floor 107 of the stacker support, forming vertical gaps between the second set of ribs and the top or substrate contacting surface of the first set of ribs 103, and lateral spacing between first set of ribs 103 for accepting a ribbed support of an unloading cart. The ribbed support of the unloading cart includes offset ribs that interlock with the ribs 103 of the stacker support to form a flat surface under a substrate stack for subsequent removal thereof.

To accommodate automatic transition from a uniform flat surface to a ribbed surface of the stacker tray, one or more of the first set of ribs 103 may include an aperture defined in a side portion of the rib. The aperture may be a vertically extending aperture such as aperture 113 of FIG. 1. A pin 112 extending in a lateral direction perpendicular to vertically extending aperture may be attached to the second set of ribs, and received by the aperture wherein the pin is slidably seated in the aperture 113. As elevator movement causes the stacker tray to descend from a stack loading or UP position, the first set of ribs 103 may be caused to stop moving. For example, movement may be stopped by a floor 107 to which the first set or ribs 103 are connected contacting a structure of a stacker system 100. Whether the second set of ribs 105 is connected to the elevator movement, or the second set of ribs 105 is permitted to fall freely at the second unloading position, the second set of ribs 105 falls below the first set of ribs 103 when the first of ribs is caused to stop at the second unloading position.

In particular, when the first set of ribs 103 stops at the second unloading position, the pin 112 connected to the second set of ribs 105 slides downward within aperture 113, permitting the second set of ribs 105, which are shorter than the first set of ribs 103, to continue descending until the second set of ribs 105 are caused to stop by, for example, the stacker support floor 107.

Figure 2:
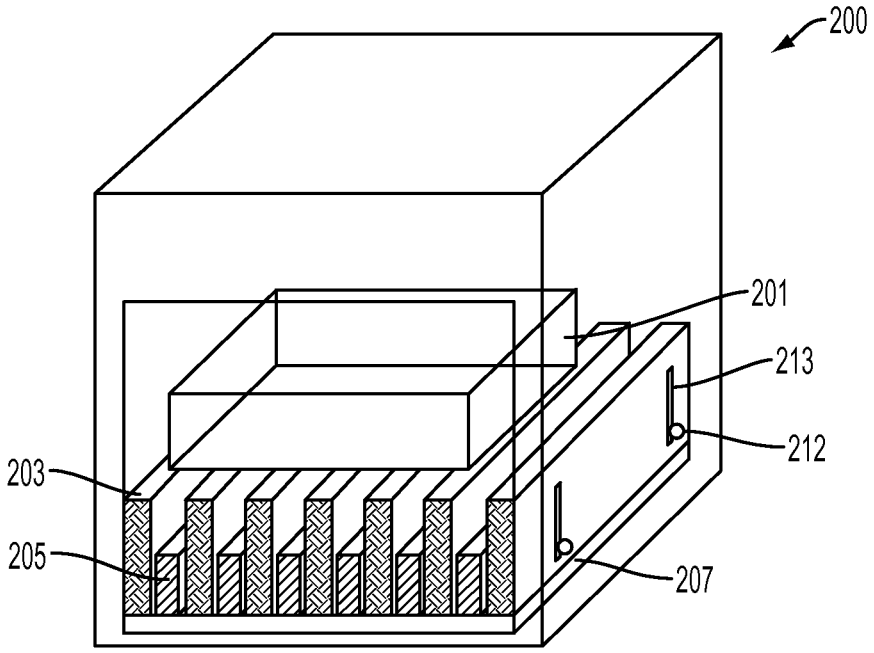
FIG. 2 shows a diagrammatical front perspective view of a substrate processing system in accordance with an exemplary embodiment.

FIG. 2 shows a system 200 including a stacker support connected to an elevator system (not shown). FIG. 2 shows a substrate stack 201 resting on a ribbed surface formed by a first set of ribs 203 of a stacker support. The stacker support also includes a second set of ribs 205 that are slidably mounted to the first set of ribs 203 by way of a pin 212. The pin is mounted within a vertically extending aperture 213, and permits the second set of ribs 205 to move with respect to the first set of ribs 203. One or more pin/aperture arrangements may be implemented.

As shown in FIG. 2, the first set of ribs 203 is caused to stop at a second unloading position. In the second unloading position, gaps are formed between a top surface of the second set of ribs 205 and a top surface of the first set of ribs 203. To reach this position, the second set of ribs 203 is caused to continue movement until the second set of ribs 203 rests on the floor 207 of the stacker support, or until the pin 212 is stopped by an end of the aperture 213. For example, elevator components may be attached to the second set of ribs 205, the first set of ribs 203 being caused to move by way of the elevator components through the second set of ribs 205. As the second set of ribs 205 is caused to ascend, the pin(s) 212 may be stopped by an upper end of the aperture(s) 213 as the top surface of the second set of ribs 205 aligns with the top surface of the first set of ribs 203. As the second set of ribs 205 continues to ascend, the first set of ribs 203 may be lifted by the pin(s) connected to the second set of ribs 205 until the stacker support reaches a first UP or stack loading position as shown in FIG. 1.

Figure 3:
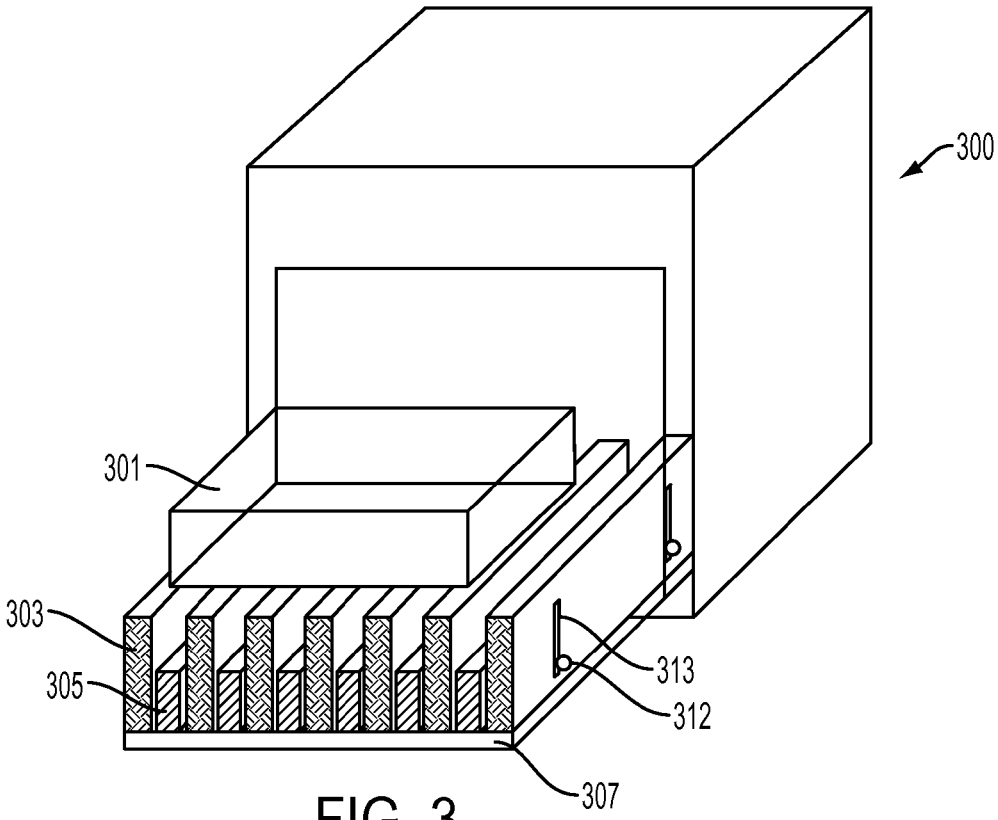
FIG. 3 shows a diagrammatical front perspective view of a substrate processing system in accordance with an exemplary embodiment.

FIG. 3 shows a system 300 including a stacker support connected to an elevator system (not shown). FIG. 3 shows a substrate stack 301 resting on a ribbed surface formed by a first set of ribs 303 of a stacker support. The stacker support also includes a second set of ribs 305 that are slidably mounted to the first set of ribs 303 by way of a pin 312. The pin is mounted within a vertically extending aperture 313, and permits the second set of ribs 305 to move with respect to the first set of ribs 303. One or more pin/aperture arrangements may be implemented. In a first loading position, the stacker support may be in an UP position, or in a position between the UP position and the second unloading position. In a loading position, a top surface of the first set of ribs 303 and a top surface of the second set of ribs 305 are aligned to form a uniform continuous surface as shown in FIG. 1.

FIG. 3 shows the stacker support in the unloading position wherein the first set of ribs 305 forms a ribbed surface upon which the substrate stack 301 rests. The second set of ribs 305 are caused to descend below the first set of ribs 303 so that the top surface of the second set of ribs 305 is below the top surface of the first set of ribs 303. The gaps between the top surfaces of the first set of ribs 303 and the second set of ribs 305, and the resulting lateral spacing between the ribs of the first set of ribs 303, permits receipt of a ribbed support of an unloading cart for unloading of the substrate stack 301 form the stacker support and system 300. FIG. 3 also shows that the stacker support may be configured to be at least partially removed from a housing of the system 300 to permit access to the stacker support.

Figure 4:
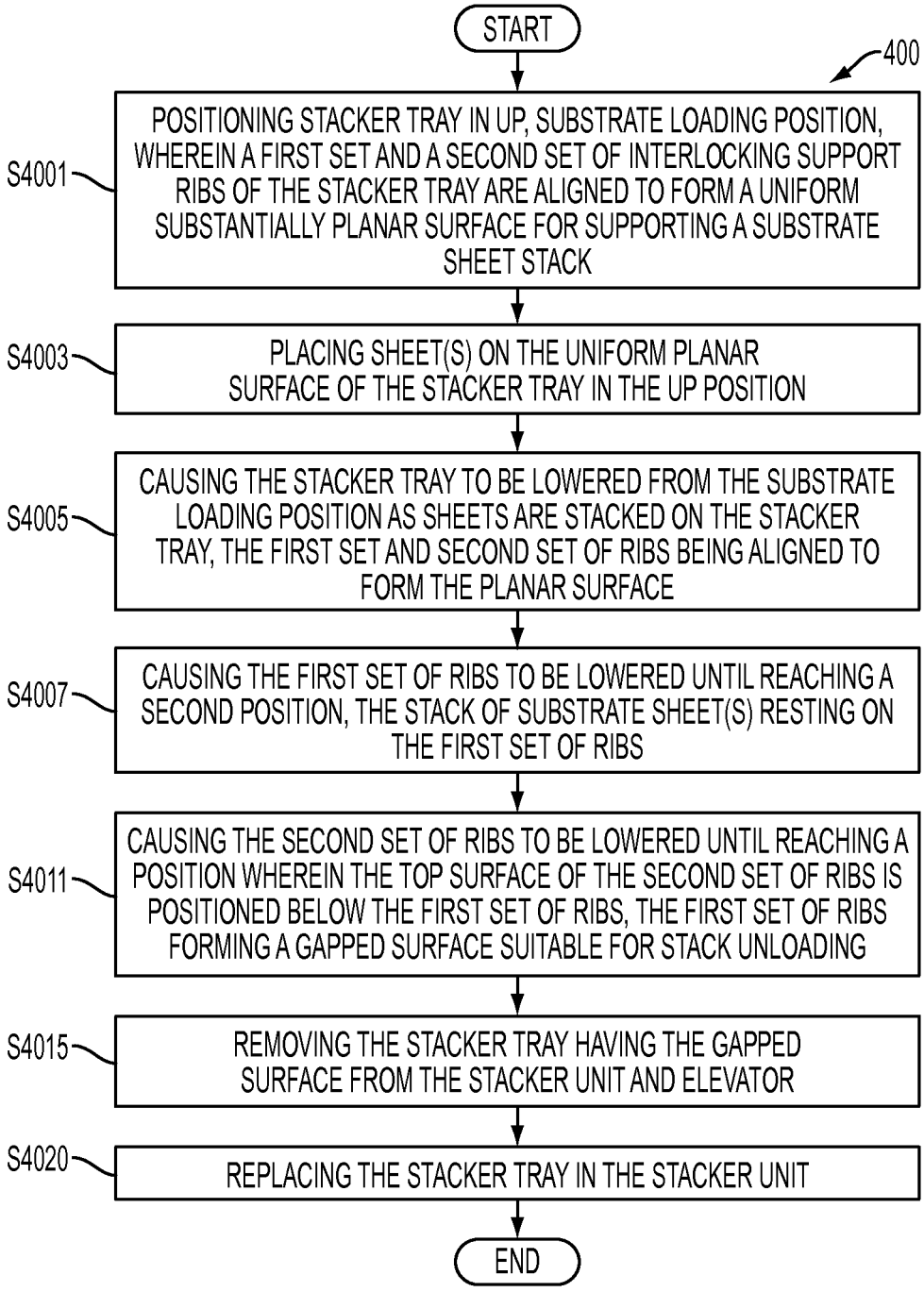
FIG. 4 shows a substrate stacking and unloading process in accordance with an exemplary embodiment.

FIG. 4 shows a substrate stacking and unloading process in accordance with an embodiment. In particular, FIG. 4 shows a process 400 for stacking and unloading flexible media such as paper sheets. Methods may include positioning a stacker support or tray in an UP position, a substrate loading position, at S4001. Sheets may be placed on the stacker tray surface in the UP position at S4003. In the UP position, and in loading positions between the UP position and an unloading position, the surface of the stacker support is uniform and continuously flat.

At S4005, the stacker support may be caused to descend from a first loading position, e.g., the UP position, as sheets are stacked on the flat surface of the stacker substrate. The flat surface of the stacker support is formed by a first set of ribs and a second set of ribs wherein the top surfaces thereof are aligned.

At S4007, the stacker support may be caused to descend until reaching a second unloading position at which the first set of ribs is caused to stop movement. At the second unloading position, the second set of ribs is caused to continue movement at S4011 whereby the top surface of the second set of ribs is positioned below the top surface of the first set of ribs, thereby forming a vertical gap between the top surfaces of the first and second rib sets, and lateral spacing between the ribs of the first set of ribs that accommodates receipt of offset ribs of a stack unloading cart.

The stacker support may be removed at least partially from a housing of the system at S4015. For example, the support may be a slidably mounted tray configured to be pulled out from the system housing. After unloading of a stack of substrates onto a stack unloading cart, the stacker tray may be pushed back into the system housing at S4020.

Embodiments as disclosed herein may also include computer-readable media for carrying or having computer-executable instructions or data structures stored thereon. Such computer-readable media can be any available media that can be accessed by a general purpose or special purpose computer. By way of example, and not limitation, such computer-readable media can comprise RAM, ROM, EEPROM, CD-ROM or other optical disk storage, magnetic disk storage or other magnetic storage devices, or any other medium which can be used to carry or store desired program code means in the form of computer-executable instructions or data structures. When information is transferred or provided over a network or another communications connection (either hardwired, wireless, or combination thereof) to a computer, the computer properly views the connection as a computer-readable medium. Thus, any such connection is properly termed a computer-readable medium. Combinations of the above should also be included within the scope of the computer-readable media.

Computer-executable instructions include, for example, instructions and data which cause a general purpose computer, special purpose computer, or special purpose processing device to perform a certain function or group of functions. Computer-executable instructions also include program modules that are executed by computers in stand-alone or network environments. Generally, program modules include routines, programs, objects, components, and data structures, and the like that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described therein.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art.

What is claimed is:

1. A media stacking system suitable for processing flexible substrate sheets, comprising:

a stacker support, the stacker support including a first set of a ribs and a second set of ribs;

a housing, the stacker support being configured move within the housing between a first position and a second position, wherein the first position is a substrate loading position and the second position is a substrate unloading position;

at least one rib of the first set of ribs defining an aperture; and a pin slidably seated within the aperture of the at least one rib of the first rib set, the pin being connected to the second rib set.

2. The system of claim 1, comprising the first set of ribs and the second set of ribs being separately movable, and being aligned in the first position to form a flat surface for supporting the substrate sheets.

3. The system of claim 2, comprising the first set of ribs and the second set of ribs being unaligned in the second position whereby a top surface of the first set of ribs forms a ribbed surface for supporting the substrate sheets.

4. The system of claim 3, wherein the first set of ribs have a greater height than the second set of ribs.

5. The system of claim 4, wherein the second set of ribs are connected to an elevator system for causing movement of the stacker support.

6. The system of claim 1, comprising the pin and the aperture being configured wherein when the elevator system causes the second set of ribs to move toward the first position, the second set of ribs causes the pin to move to contact a first end of the aperture to lift the first set of ribs during the movement to the first position.

7. The system of claim 6, comprising the pin and the aperture being configured wherein when the elevator system causes the second set of ribs to move toward the first position, the first set of ribs may be stopped while the second set of ribs continues to move, the pin sliding along the aperture to a second end of the aperture until the second set of ribs is stopped at the second position.

8. A stacker apparatus, comprising:

a first set of ribs;

a second set of ribs, the first set of ribs being taller than the second set of ribs, and the first set of ribs being separately movable from second set of ribs;

at least one pin, the at least one pin being connected to the second set of ribs; and at least one aperture, the at least one aperture being defined by at least one of the first set of ribs, the pin extending through the aperture and being slidably seated therein to permit movement of the second set of ribs separate from the first set of ribs.

9. The apparatus of claim 8, comprising:

a floor, a bottom of the first set of ribs being connected to the floor, the second set of ribs being separately movable from the floor.

10. The apparatus of claim 8, comprising the pin and aperture being configured whereby when the second set of ribs is caused to move toward a loading position, the second set of ribs causes the pin to slide within the aperture until contacting an end of the aperture, wherein a top surface of the first set of ribs and a top surface of the second set of ribs are caused to align to form a uniform continuously flat surface.

11. The apparatus of claim 8, comprising the pin and the aperture being configured whereby when the second set of ribs is caused to move toward an unloading position, the second set of ribs causes the pin to slide within the aperture from a point at which the pin contacts a first end the aperture until the pin contacts a second end of the aperture, or a bottom of the second set of ribs contacts a floor of the stacker support.

* * * * *